US006673005B2

(12) United States Patent
Blanchard

(10) Patent No.: US 6,673,005 B2
(45) Date of Patent: Jan. 6, 2004

(54) DEVICE FOR GUIDING SIGNATURES, PARTICULARLY IN THE REGION OF A WEDGE-SHAPED OUTLET OF A CUTTING CYLINDER DEVICE IN A FOLDER OF A ROTARY PRINTING MACHINE

(75) Inventor: Alain Blanchard, Gouvieux (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 130 days.

(21) Appl. No.: 09/930,410

(22) Filed: Aug. 15, 2001

(65) Prior Publication Data

US 2002/0022561 A1 Feb. 21, 2002

(30) Foreign Application Priority Data

Aug. 15, 2000 (DE) ..... 100 40 580

(51) Int. Cl.[7] ..... B31F 1/00

(52) U.S. Cl. ..... 493/460; 493/461; 493/436; 493/441; 493/475; 83/155

(58) Field of Search ..... 493/343, 265, 493/370, 460, 461, 441, 432, 436, 475, 478, 479; 83/194–199, 164–165, 155, 157; 271/264, 69; 198/8, 14, 454, 457.06, 457.03

(56) References Cited

U.S. PATENT DOCUMENTS

| | | | | |
|---|---|---|---|---|
| 4,385,537 A | | 5/1983 | Wolf | |
| 4,987,809 A | * | 1/1991 | Price | 83/155 |
| 5,230,268 A | * | 7/1993 | Richter | 83/155 |
| 5,820,122 A | * | 10/1998 | Schneider | 271/264 |
| 5,839,365 A | | 11/1998 | Calbrix et al. | |
| 5,873,306 A | | 2/1999 | Cote et al. | |
| 6,073,755 A | | 6/2000 | Hilliard et al. | |
| 6,170,371 B1 | | 1/2001 | Cote et al. | |

FOREIGN PATENT DOCUMENTS

| | | |
|---|---|---|
| CA | 1 094 145 | 1/1981 |
| DE | 72 116 14.4 | 3/1972 |
| DE | 27 43 801 B2 | 4/1979 |
| DE | 197 31 364 A1 | 3/1998 |
| DE | 198 06 172 A1 | 10/1998 |
| DE | 198 26 334 A1 | 1/1999 |
| DE | 199 49 223 A1 | 5/2000 |

* cited by examiner

*Primary Examiner*—Rinaldi I. Rada
*Assistant Examiner*—Michelle López
(74) *Attorney, Agent, or Firm*—Laurence A. Greenberg; Werner H. Stemer; Ralph E. Locher

(57) ABSTRACT

A device for guiding signatures in a folder of a rotary printing machine includes at least one guide belt disposed near a transporting path of the signatures, and extending transversely to a transporting direction of the signatures, the at least one guide belt being formed with guide surfaces defining the transporting path.

13 Claims, 4 Drawing Sheets

Fig.1

DEVICE FOR GUIDING SIGNATURES, PARTICULARLY IN THE REGION OF A WEDGE-SHAPED OUTLET OF A CUTTING CYLINDER DEVICE IN A FOLDER OF A ROTARY PRINTING MACHINE

BACKGROUND OF THE INVENTION

Field of the Invention

The invention relates to a device for guiding signatures, particularly in the region of a wedge-shaped outlet of a cutting-cylinder device in a folder of a rotary printing machine.

Folders of rotary printing machines, particularly of web-fed rotary offset printing machines, are beset by a problem that, after a longitudinal folding operation on a continuous paper web, signatures severed therefrom by revolving cutting blades do not undergo any defined guidance during and after the cutting operation. This may result in disruptions during the subsequent transportation of the signatures, if the latter enter, for example, onto endless transporting belts arranged downline in the cutting-cylinder arrangement, above and below the transporting path of the signatures, in order for the latter to be fed to a further-processing device, in particular a folder.

One of the most common causes of disruption occurring as the signatures enter onto the downline transporting belts is that the leading corners of the signatures fold over and form so-called "dog ears" as the signatures enter onto the transporting belts. This results not only in the printed products being unusable as such, and having to be separated out in corresponding downline devices, for example, in reject or waste paper diverters, but rather also, there arises a risk that the damaged signatures, during subsequent folding operations, result in a paper build-up which may frequently be associated with production failures or even damage to the folder.

It has become known heretofore from U.S. Pat. No. 4,385,537, to provide, in the region of the wedge-shaped outlet of a cutting-cylinder arrangement, an upper and a lower transporting belt which are guided, respectively, over a deflecting roller which is displaceable within the wedge-shaped outlet. This U.S. patent offers no indication or suggestion of providing, in the region of the wedge-shaped outlet of the cutting-cylinder arrangement, any further guide devices which avoid the situation wherein the leading corners of the signatures fold or crease over as the signatures enter onto the transporting belt.

The published German Non-prosecuted Patent Application (DE-OS) 27 43 801 A1 describes a rotary cross cutter in which there is provided in the region of the wedge-shaped outlet, between the two cutting cylinders, a table which extends over the entire width of the cutting cylinders and is accommodated on a resiliently elastic mounting support which is displaceable in the transporting direction of the signatures. The resiliently elastic mounting support is provided so as to ensure that a signature build-up in the region of the wedge-shaped outlet does not result in damage to the table or to the transporting belts arranged downline from the table, above and below the transporting path of the signatures. Despite the high-outlay resiliently elastic mounting support of the table, the leading ends of the signatures are not prevented by the table from folding over as the signatures enter into the downline transporting belts.

SUMMARY OF THE INVENTION

Accordingly, it is an object of the invention of the instant application to provide a device for guiding signatures in the region of a web-shaped outlet of a cutting-cylinder device in a folder of a rotary printing machine, which is of straightforward and cost-effective construction, in case of a paper buildup, is not prone to damage, or in the case of damage can be replaced cost-effectively, and allows the signatures to be guided reliably in a downline transporting device.

With the foregoing and other objects in view, there is provided, in accordance with the invention, a device for guiding signatures, in a folder of a rotary printing machine, comprising at least one guide belt disposed near a transporting path of the signatures, and extending transversely to a transporting direction of the signatures, the at least one guide belt being formed with guide surfaces defining the transporting path.

In accordance with another feature of the invention, the signature-guiding device is in combination with a cutting-cylinder device having a wedge-shaped outlet within a region of which, the signature-guiding device is disposed.

In accordance with a further feature of the invention, the at least one guide belt is an endless guide belt extending over two first and second deflecting rollers arranged on mutually opposite sides of the signature-guiding device, so that the guide surfaces are formed by respective mutually opposite inner sides of the endless guide belt, between which the signatures run through the signature-guiding device.

In accordance with an added feature of the invention, the signature-guiding device includes at least another guide belt, the one and the other guide belts being arranged on mutually opposite sides of the transporting path of the signatures so that respective outer sides of the one and the other guide belts form the guide surfaces.

In accordance with an additional feature of the invention, the guide surfaces face towards the signatures, and are disposed at an angle to the transporting path of the signatures, so as to produce a funnel-like inlet region into which the signatures enter by leading edges thereof.

In accordance with yet another feature of the invention, the angle between at least one of the one and the other guide belt, on the one hand, and the transporting path of the signatures, on the other hand, is variable.

In accordance with yet a further feature of the invention, the at least one guide belt is disposed in a region between a cutting-cylinder pair and a transporting-belt device located downline therefrom, as viewed in the transporting direction of the signatures, in a folder of a web-fed rotary printing machine.

In accordance with yet an added feature of the invention, the signature-guiding device includes at least another guide belt, each of the guide belts having a tensioning device assigned thereto.

In accordance with yet an additional feature of the invention, the tensioning device includes a lever arm, an actuating device for pivoting the lever arm about a pivot pin, and a deflecting roller whereover a respective guide belt extends, the deflecting roller being rotatably secured on the lever arm.

In accordance with still another feature of the invention, the actuating device includes a spring for acting on the lever arm, and a cam assigned to the lever arm, the spring and the cam cooperating with one another so that, by rotation of the cam, the lever arm is movable from a first and tensioning position into a second position, wherein the respective guide belt is not tensioned.

In accordance with still a further feature of the invention, the actuating device for acting on the lever arm is at least one of a pneumatic cylinder and an electrical actuator, respectively, by which the lever arm is pivotable from a first and tensioning position into a second position, wherein the guide belt is not tensioned.

In accordance with still an added feature of the invention, the distance between the guide belts, on the one hand, and the transporting path of the signatures, on the other hand, is variable.

In accordance with still an additional feature of the invention, the guide belts extend over deflecting rollers which have a characteristic selected from the group of characteristics consisting of being eccentrically mounted and non-round, respectively, the distance between the guide belts, on the one hand, and the transporting path of the signatures, on the other hand, being variable due to rotation of the deflecting rollers.

In accordance with a concomitant feature of the invention, the guide surfaces face towards the signatures and are provided with a friction-reducing coating.

According to the invention, the device for guiding signatures in the region of a wedgeshaped outlet of a cutting-cylinder device in a folder of a rotary printing machine is distinguished in that, arranged in the vicinity of the transporting path of the signatures, are one or more flat guide belts which extend virtually transversely to the transporting direction of the signatures, the flat or planar belt surfaces forming guide surfaces which bound or define the transporting path of the signatures and are arranged at least on one side of the transporting path of the signatures, but preferably on both sides of the signature-transporting path. The guide belts, which may be formed, for example, of metal, plastic, rubber or some other suitable material, may have a width which is adapted to the respective construction of the folder and may be, for example, in the range between a few cm to 0.4 m. The thickness of the metal belts is likewise dependent upon the respective dimensioning of the cutting-cylinder device and may be, for example, 0.2 to 2.5 mm.

Using the guide belts according to the invention in the region of the wedge-shaped outlet of a cutting-cylinder device offers the advantage that, even in the case of cutting cylinders with a very small diameter, the upline edges of the belts can be advanced very closely up to the cutting region, with the result that the region wherein the leading edges of the signatures are not guided after the cutting operation can be kept extremely small. In addition, the guide belts according to the invention provide the advantage that, in the case of a paper build-up, they yield automatically due to their own elasticity, as a result of which, damage like that which may occur, in particular, in the case of fixedly installed guide plates is ruled out from the outset. Should, however, a paper build-up result in damage to one of the guide belts according to the invention, then this guide belt can be exchanged straightforwardly and cost-effectively in an extremely short period of time, because the belt material which is to be replaced may be supplied, for example, in the form of supply reels and drawn into the machine by the machine operator himself or herself. In contrast with solid fixedly installed guide devices, in the case of which, damage to the device as a result of a paper build-up usually results in the printing machine being at a standstill for a relatively long period of time, use of the signature-guiding device according to the invention allows the printing operation to be resumed after an extremely short period of time.

According to a preferred embodiment of the invention, an endless guide belt is guided over two, first and second deflecting rollers arranged on mutually opposite sides, preferably outside the transporting path of the signatures. The guide surfaces, which are directed toward the top side and underside of the signatures, are formed here by the mutually opposite inner sides of the endless guide belt, between which the signatures run. The described embodiment provides the advantage that reliable guidance of the signatures takes place by using only a single endless guide belt.

Instead of using two guide rollers, it is likewise conceivable for an open-ended guide belt to be correspondingly extended over just one deflecting roller, which may be fastened, for example, on one of the side walls of the folder, and for the two ends of the open-ended guide belt to be fastened, for example, on the opposite side wall of the folder, preferably via a resiliently elastic device.

According to a further embodiment of the invention, a first and a second open-ended guide belt are arranged separately from one another on mutually opposite sides of the transporting path of the signatures. The first and/or the second guide belt may advantageously be arranged here at an angle to the transporting path of the signatures, so as to produce a somewhat funnel-like inlet region into which the signatures enter by way of the leading edges thereof. This offers the advantage that the formation of "dog ears" is avoided in a particularly effective manner. Furthermore, the angle at which the two separate guide belts are arranged in relation to the transporting path of the signatures may advantageously be adjustable, as a result of which it is possible to achieve adaptation to different signature thicknesses, signature formats, printing materials and machine speeds.

According to a further embodiment of the invention, each of the guide belts preferably has a separate tensioning device assigned thereto, which, in the simplest case, may be formed, for example, by a tension spring which has adjustable prestressing and acts on one end or both ends of a guide belt according to the invention and is supported, for example, on the frame of the folder.

According to a preferred embodiment of the invention, however, the tensioning device is formed by a lever arm which can be pivoted about a pivot pin via an actuating device. Fastened onto the lever arm is a deflecting roller, over which a respective guide belt extends. The actuating device advantageously includes here a spring, subjecting the lever arm to a resiliently elastic force, for example, a helical tension spring or a helical compression spring, and a rotatable cam, which is assigned to the lever arm, and on which the lever arm is supported. The cam and the spring cooperate with one another here so that, by rotation of the cam, the lever arm can be moved from a first, tensioning position, wherein the guide belt according to the invention is subjected to a predetermined resiliently elastic force, into a second position, wherein the guide belt remains untensioned and can be fastened onto the lever arm, for example by hand, via corresponding hooks or similar fastening elements. The embodiment just described allows the tensioning of the guide belt to be changed by rotating the cam, with the result that, depending upon a printing order which is to be processed in each case, the signature-guiding device can be adapted to the respective conditions, for example, by manual or motor-driven rotation of the cam.

In the same way, provision may be made for the actuating device to be formed by a pneumatic cylinder acting on the lever arm, or an electrical actuator, which pivots the lever arm, for the purpose of tensioning the guide belt, into a first, tensioning position and, for example, for the purpose of fastening the belt end on the lever arm, into a second position, wherein the guide belt is in a non-tensioned state. It is conceivable here for the tensioning of one or more of the guide belts to take place in dependence upon the operating state of the printing machine so that, when the printing machine is at a standstill or during an emergency stop, the lever arm is automatically pivoted into the second position, wherein the guide belt is not tensioned. As a result, it is possible, for example, for the operation of threading a new paper web in the region of the wedge-shaped outlet of the cutting-cylinder device after a web break, or prior to a new printing order with a different paper width, to be simplified to a considerable extent and, in the case of a web break or paper build-up in the region of the wedge-shaped outlet, further risk of damage to be reduced to a considerable extent. Furthermore, it is also possible, for adapting to different printing orders or operating conditions of the printing machine, to change the distance between the guide belts and the transporting path of the signatures. For this purpose, provision may be made, for example, for the guide belts to be guided over eccentrically mounted deflecting rollers or over non-round, in particular over elliptically shaped, deflecting rollers, with the result that a change in the distance between the guide belts and the transporting path of the signatures is made possible by virtue of the eccentrically mounted or non-round deflecting rollers being rotated. The rotation of the eccentrically mounted deflecting rollers or non-round deflecting rollers can take place here either manually or via corresponding actuators, for example via electric motors or pneumatic cylinders, automatically and preferably in dependence upon the operating state of the printing machine, in particular in dependence upon the printing order and the machine speed.

In order to reduce friction and, furthermore, also to reduce smearing of the signatures, which were previously printed in the printing machine, on the guide surfaces of the guide belts according to the invention, it is possible, in particular, for the guide surfaces, which are directed towards the signatures, to be provided with a corresponding coating, for example, with PTFE (Teflon® or polytetrafluorethylene) or chromium, and so forth.

Other features which are considered as characteristic for the invention are set forth in the appended claims.

Although the invention is illustrated and described herein as embodied in a device for guiding signatures, particularly in the region of a wedge-shaped outlet of a cutting-cylinder device in a folder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
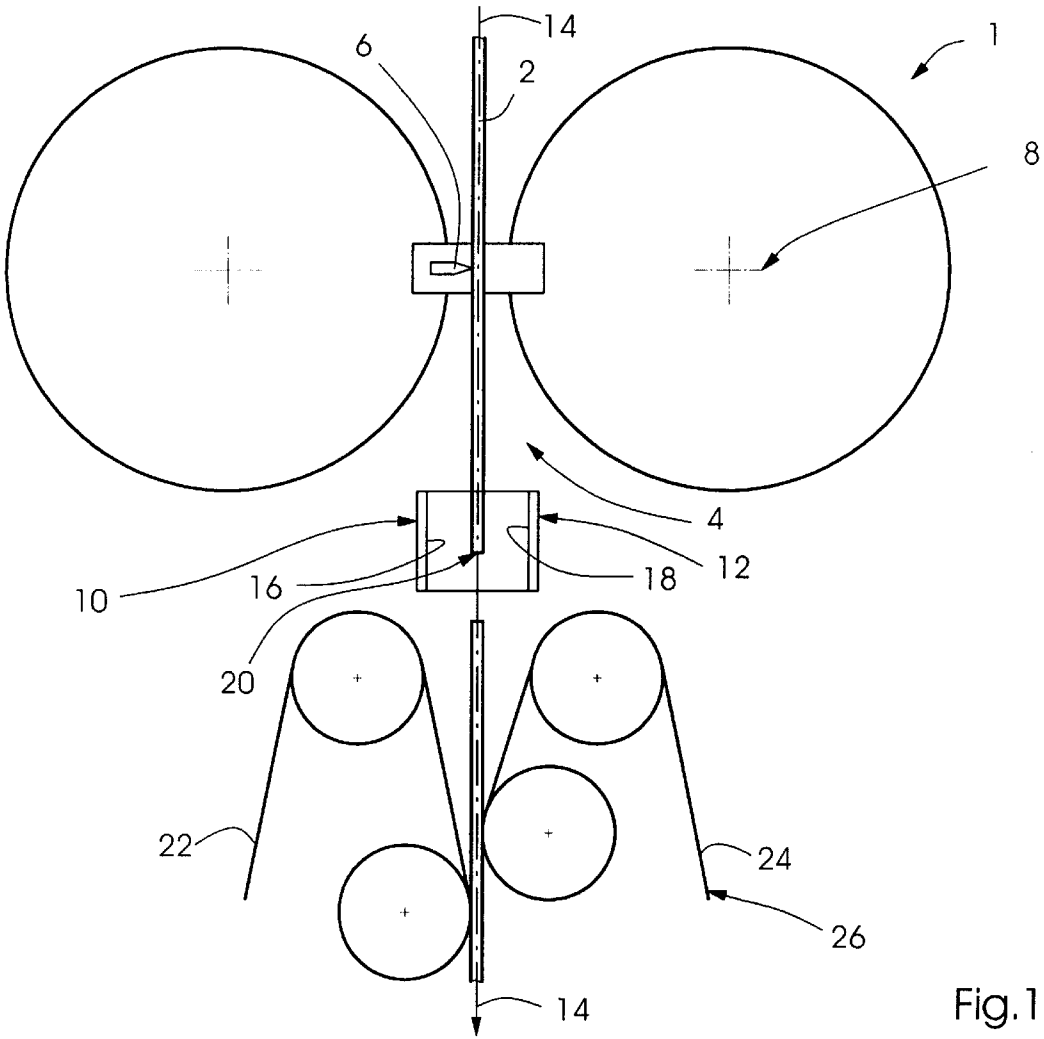
FIG. 1 is a diagrammatic side elevational view of a signature-guiding device according to the invention having a first and a second guide belt arranged at least approximately parallel to a transporting path of the signatures.

Referring now to the drawings and, first, particularly to FIG. 1 thereof, there is shown therein a signature-guiding device 1 according to the invention provided for guiding signatures 2 in the region of a wedge-shaped outlet 4 of a cutting-cylinder device 8 having a cutting blade 6, which is included in an otherwise non-illustrated folder of a web-fed rotary printing machine, the signature-guiding device 1 having one or more flat guide belts 10, 12 according to the invention which are arranged on both sides of a signature-transporting path 14. The guide belts 10 and 12 have respective guide surfaces 16 and 18 which are directed towards the outer sides of the signatures 2 and guide leading ends 20 of the signatures 2 in the region of the wedge-shaped outlet 4 and, as the signatures enter onto a transporting-belt device 26 formed by transporting belts 22 and 24, in order to prevent the leading ends 20 of the signatures 2 from creasing or folding over as the signatures enter the transporting-belt device 26.

Figure 3:
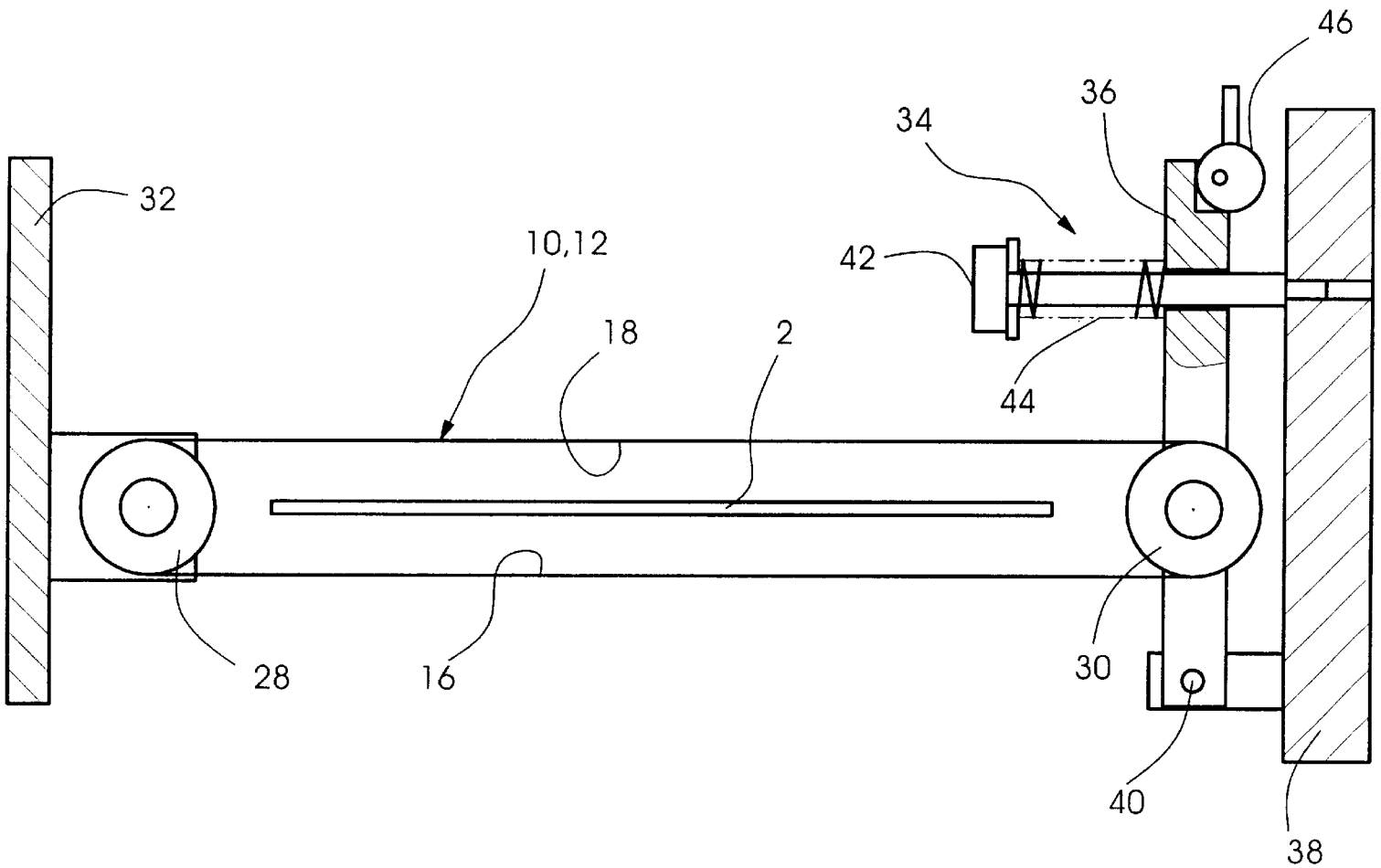
FIG. 3 is a cross-sectional view of the first embodiment of the signature-guiding device according to the invention, facing in the direction of the signature-transporting path, wherein an endless guide belt is guided over two deflecting rollers located outside the transporting path.

As is illustrated in FIG. 3, the signature-guiding device 1 according to the invention includes two deflecting rollers 28 and 30, one deflecting roller 28 of which is arranged on a first side wall 32 of the printing machine, and the other deflecting roller 30 is fastened rotatably on a tensioning device 34, which is movable relative to a second side wall 38. The tensioning device 34 here includes a lever arm 36 which is pivotable about a rotary pin 40 which is preferably stationary relative to the second side wall 38 of the folder. The lever arm 36 is forced, by a spring 44 which can be prestressed by an adjusting screw 42, against a rotatable eccentrically mounted or non-round cam 46 so that, by rotating the cam 46, the lever arm 36 can be pivoted from the tensioning position for the guide belts 10 and 12, which is illustrated in FIG. 3, into a non-illustrated position wherein the guide belts 10 and 12 according to the invention are in a non-tensioned state and are removable, for example, easily from the deflecting rollers 28 and 30. As can also be concluded from FIG. 3, the signatures 2 are guided through, between the inner sides 16 and 18, respectively, of the endless guide belts 10 and 12, those inner sides 16 and 18 being providable with a coating which reduces friction, or prevents smearing of the signatures 2, and forming guide surfaces.

Figure 4:
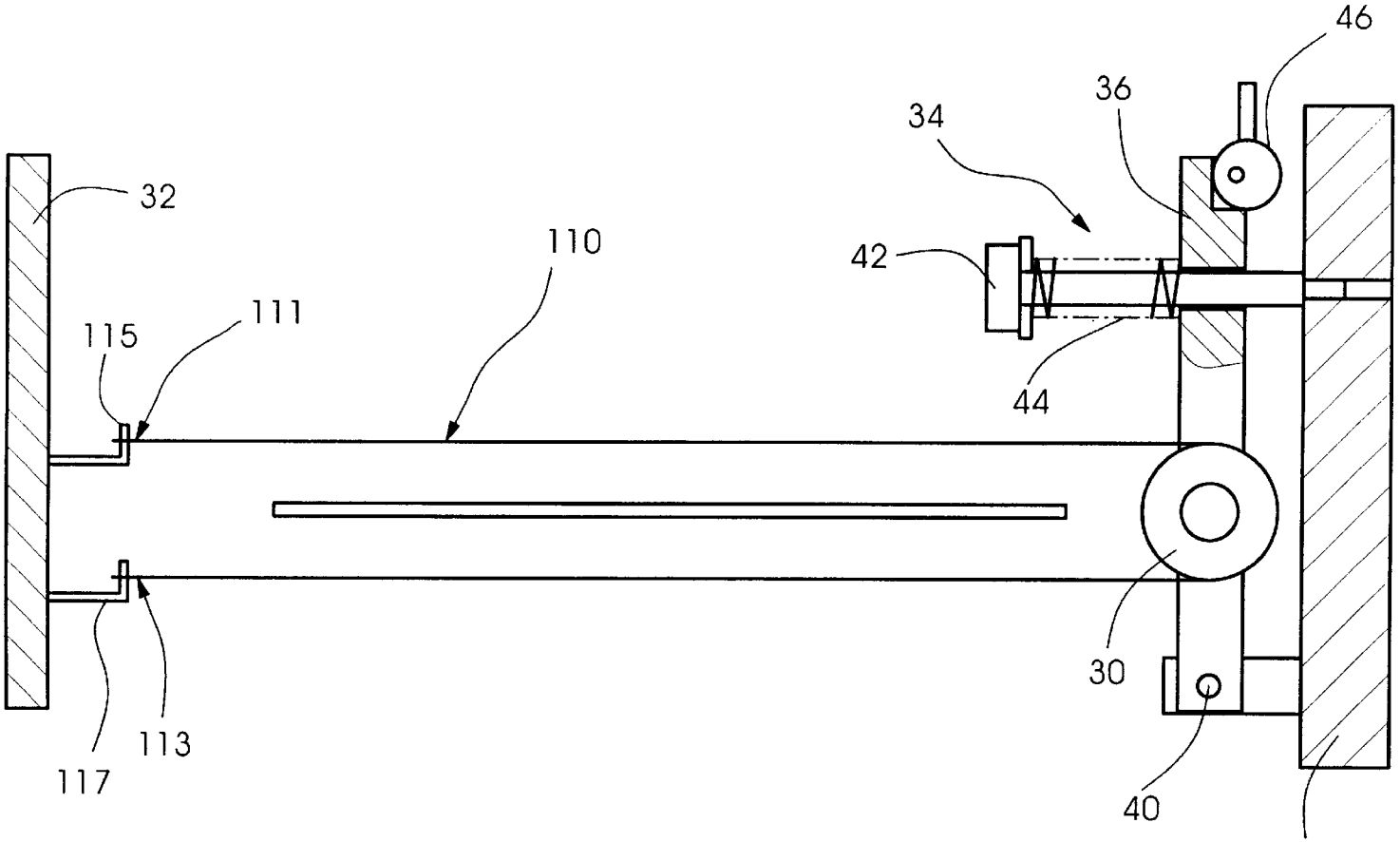
FIG. 4 is a view like that of FIG. 3 of a further embodiment of the signature-guiding device according to the invention, wherein an open-ended belt is guided over a deflecting roller fastened to a tensioning lever, both ends of the belt being fastened by hooks to an opposite side wall of the folder.

Instead of using a deflecting roller 28 locally fixed to the first side wall 32 of the folder, it may also be advantageous, as shown in FIG. 4, to use an open-ended guide belt 110, the ends 111 and 113 of which are fastened to the first side wall 32 of the folder with the aid of a fastening device, in particular by hooks 115 and 117, respectively, which engage in the respective ends 111 and 113 of the open-ended guide belt 110.

Figure 2:
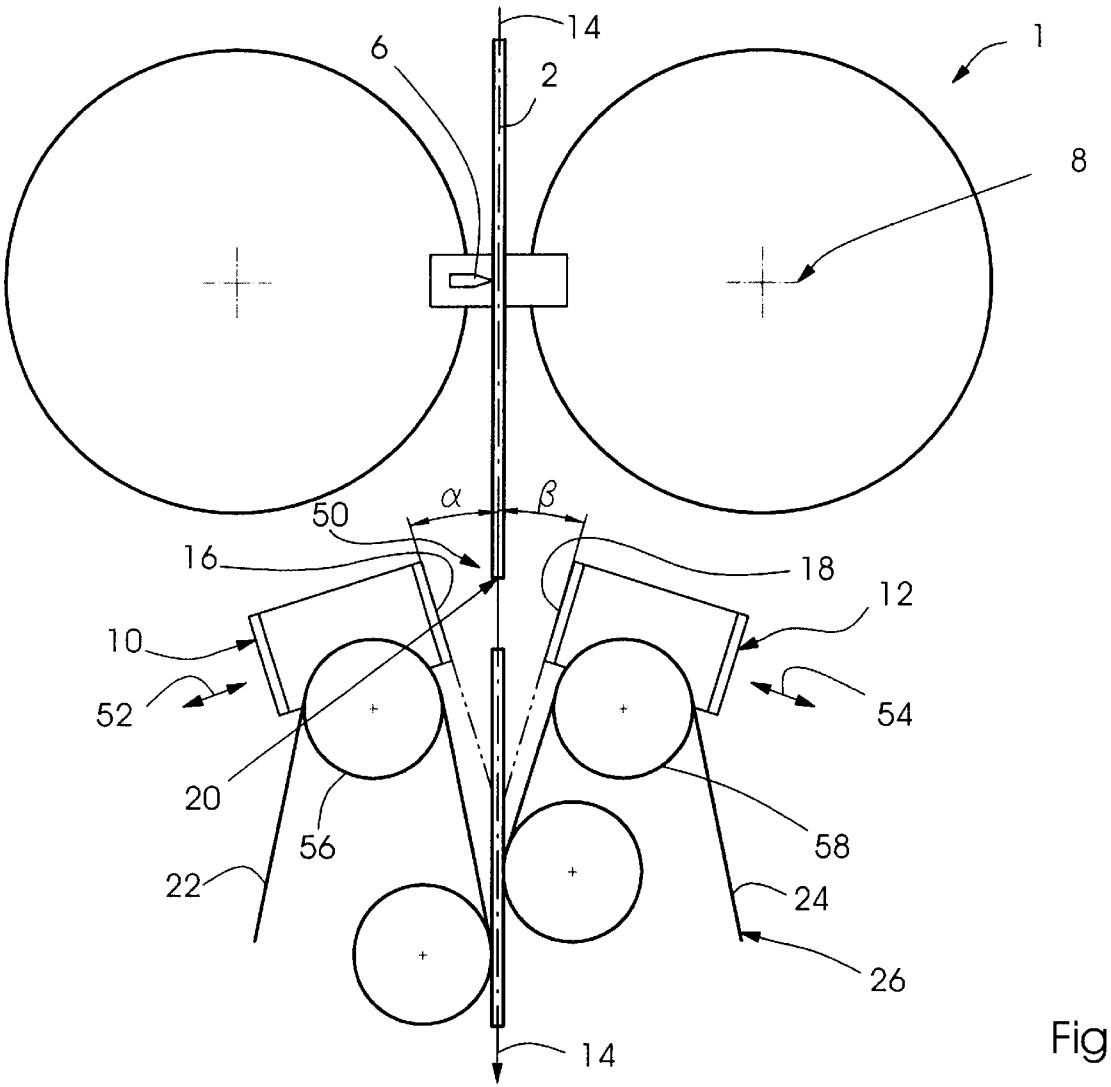
FIG. 2 is a view similar to that of FIG. 1 of a further embodiment of the signature-guiding device according to the invention, wherein, above and below the transporting path of the signatures, the first and the second guide belts are arranged at an angle to the transporting path and form a funnel-shaped inlet region for leading edges of the signature into a downline section of the transporting belts.

According to the further embodiment of the invention, which is illustrated in FIG. 2, the guide belts 10 and 12 are preferably inclined at an angle α and β, respectively, relative to the transporting direction 14 of the signatures 2 and form a conical or funnel-like inlet region 50. As is indicated by the double-headed arrows 52 and 54, the guide belts 10 and 12, respectively, which may be formed like the guide belts of the embodiment of the invention which is illustrated in FIG. 3 and in FIG. 4, are arranged so as to be displaceable relative to the transporting path 14 of the signatures 2, so that it is possible to vary the distance between the guide surfaces 16 and 18 of the belts 10 and 12, on the one hand, and the transporting path 14 of the signatures, on the other hand.

As is also apparent from FIG. 2, the deflecting rollers 56 and 58 for the transporting belts 22 and 24, respectively, of the transporting-belt device 26 may be arranged within the interspace defined by the guide belts 10 and 12, respectively, due to which a particularly compact arrangement is achieved.

I claim:

1. A device for guiding signatures in a folder of a rotary printing machine, comprising a first guide belt and a second guide belt having respective outer sides disposed on mutually opposite sides of a transporting path of the signatures, and extending transversely to a transporting direction of the signatures, said respective outer sides of said first and second guide belts forming guide surfaces, and defining the transporting path therebetween.

2. The signature-guiding device according to claim 1, wherein said guide surfaces face towards the signatures, and are disposed at an angle to said transporting path of the signatures, so as to produce a wedge-shaped inlet region into which the signatures enter by leading edges thereof.

3. The signature-guiding device according to claim 2, wherein said angle between said guide surfaces is a variable angle.

4. The signature-guiding device according to claim 1, in combination with a cutting-cylinder device having a wedge-shaped outlet within a region of which the signature-guiding device is disposed.

5. The signature-guiding device according to claim 1, wherein said first and second guide belts are disposed in a region between a cutting-cylinder pair and a transporting-belt device located downline therefrom, as viewed in said transporting direction of the signatures, in a folder of a web-fed rotary printing machine.

6. The signature-guiding device according to claim 1, wherein each of said guide belts have a tensioning device assigned thereto.

7. The signature-guiding device according to claim 6, wherein said tensioning device includes a lever arm, an actuating device for pivoting said lever arm about a pivot pin, and a deflecting roller whereover a respective guide belt extends, said deflecting roller being rotatably secured on said lever arm.

8. The signature-guiding device according to claim 7, wherein said actuating device includes a spring acting on said lever arm, and a cam assigned to said lever arm, said spring and said cam cooperating with one another so that, by rotation of said cam, said lever arm is movable from a first and tensioning position into a second position, wherein the respective guide belt is not tensioned.

9. The signature-guiding device according to claim 7, wherein said actuating device for acting on said lever arm is at least one of a pneumatic cylinder and an electrical actuator, respectively, by which said lever arm is pivotable from a first and tensioning position into a second position, wherein said guide belt is not tensioned.

10. The signature-guiding device according to claim 1, wherein the distance between said guide belts and said transporting path of the signatures is variable.

11. The signature-guiding device according to claim 1, wherein said guide surfaces face towards the signatures and are provided with a friction-reducing coating.

12. A device for guiding signatures in a folder of a rotary printing machine, comprising at least one endless guide belt disposed near a transporting path of the signatures, and extending transversely to a transporting direction of the signatures, said at least one endless guide belt being formed with guide surfaces defining said transporting path, and said at least one endless guide belt extending over first and second deflecting rollers disposed on mutually opposite sides of the signature-guiding device forming said guide surfaces with respective mutually opposite inner sides of said endless guide belt, between which the signatures run through the signature-guiding device.

13. In a folder of a web-fed rotary printing machine wherein signatures emerge from a cutting cylinder pair and travel in a given transport direction, a signature guiding assembly, comprising:

a transporting-belt device located downline from the cutting cylinder pair in the transport direction; and a signature guiding device disposed between the cutting-cylinder pair and said transporting-belt device, said signature-guiding device including at least one guide belt extending transversely to the transport direction of the signatures, and said at least one guide belt being formed with guide surfaces defining a transporting path between the cutting-cylinder pair and said transporting-belt device.

* * * * *